US006196294B1

(12) United States Patent
Ohnsmann et al.

(10) Patent No.: US 6,196,294 B1
(45) Date of Patent: Mar. 6, 2001

(54) CASTING PLANT AND METHOD OF PRODUCING CASTINGS

(76) Inventors: Gustav Ohnsmann, Adlerstrasse 12, D-84036 Landshut; Gerold Bandt, Buchenstrasse 1, D-84098 Hohenthann; Martin Ohnsmann, Johannesstrasse 23, 63846 Laufach-Hain, all of (DE)

( * ) Notice: Subject to any disclaimer, the term of this patent is extended or adjusted under 35 U.S.C. 154(b) by 0 days.

(21) Appl. No.: 09/147,097

(22) PCT Filed: Apr. 1, 1997

(86) PCT No.: PCT/DE97/00635

§ 371 Date: Feb. 22, 1999

§ 102(e) Date: Feb. 22, 1999

(87) PCT Pub. No.: WO97/37797

PCT Pub. Date: Oct. 16, 1997

(30) Foreign Application Priority Data

Apr. 4, 1996 (DE) ..... 196 13 668

(51) Int. Cl.[7] ..... B22D 18/04; B22D 27/09

(52) U.S. Cl. ..... 164/119; 164/306; 164/133; 164/137; 164/312; 164/337

(58) Field of Search ..... 164/119, 306, 164/457, 133, 137, 155.3, 312, 337, 120

(56) References Cited

U.S. PATENT DOCUMENTS 5,620,043 * 4/1997 Chamarro et al. ..... 164/119

5,913,358 * 6/1999 Chadwick ..... 164/119

* cited by examiner

*Primary Examiner*—Harold Pyon
*Assistant Examiner*—I. H. Lin
(74) *Attorney, Agent, or Firm*—Brezina & Ehrlich

(57) ABSTRACT

A casting plant for low-pressure casting of molten metal with operatively and kinematically connected units in the form of linear or revolving conveying devices. The plant includes casting molds constructed and arranged to be filled with molten metal intermittently or continuously, and disposed either in a casting or residual metal receiving station or in a separate casting station, an insulated feeder pressure pot with a recompression unit and a shutoff valve unit having gas charging conduits flanged to the underside of the casting mold, the insulated feeder pressure pot being constructed and arranged to receive excess molten metal from the casting mold after a casting therein has solidified, a casting or residual metal receiving station, disposed beneath the casting molds and including a hermetically sealed, insulated pressurized furnace in which two assembled crucibles are disposed, including an inner crucible forming a pressure chamber and which is adapted to be filled with molten metal, a furnace cover having a movable pressure line and a movable return line for the molten metal passing therethrough, the pressure line extending from the shutoff valve unit to a portion of the crucible which is constructed and arrange to be below the surface of the molten metal therein, and the return line extending from the shutoff valve unit to a portion of the crucible constructed and arranged to be above the surface of the molten metal contained therein.

71 Claims, 5 Drawing Sheets

CASTING PLANT AND METHOD OF PRODUCING CASTINGS

BACKGROUND OF THE INVENTION

The invention relates to casting equipment and a process for producing castings of the type in which the casting molds may comprise either permanent molds, that is, dies, or sand molds.

In the known low-pressure die casting process, the casting material is forced directly out of a hermetically sealed heatable pressurized container, with a slight increase in the gas pressure above the melt, through a casting tube into the casting mold located above the pressurized container. The feeding required during the solidification of the casting is assured by the melt that is under pressure and extends from the pressurized container on into the casting mold. The requisite stationary connection of the pressurized container, casting tube and casting mold over the entire process of casting and solidification of the casting leads to the following disadvantages:

- each casting mold requires at least one separate pressurized container;
- laborious melt supply due to the pressurized furnace at the casting site and the corresponding melt holding operation;
- virtually exclusively, each casting mold requires its own mechanizing aid for casting production;
- labor costs and space requirements are high.

The advantages of these methods, such as bottom gating, nonturbulent mold filling, optimally variable solidification geometry, and exclusively non-feeder casting production, are overcome by the highly cost-intensive nature of these methods.

Moreover, in German Patent Disclosure DE 1 285 682, a low-pressure casting apparatus and the process for its operation are described in which a heated feeder pressure pot with a shutoff valve and a pressure piston rests between a casting mold and a casting tube connected rigidly to the furnace cover. After the mold has been filled and the melt confined in the feeder pressure pot via the shutoff valve, the pressure on the melt can be increased arbitrarily via a piston or a pressure unit simultaneously embodied as a shutoff slide, by the actuation of this piston or unit. The solidification of the casting occurs independently of the casting furnace.

A disadvantage here is that the casting molds are filled via a large-area feeder conduit, that the removal of the casting is dependent on the solidification of the residual metal in the heated feeder pressure pot, that the casting molds have to be placed together with the feeder pressure pot on the pressurized furnace and removed from it, and that for complicated casting geometries, many feeder conduits are required.

German Published, Non-Examined Patent Disclosure DE-OS 17 83 046 also describes an injection molding machine in which casting molds are filled with melt in a stationary casting station on an continuous basis. Here the casting molds are connected to the casting station, and separated from it again after the casting has solidified, by being raised and lowered. The overflow of melt takes place directly from the casting furnace into the casting mold via a feeder conduit. The supply of molten metal to the casting furnace is assured by a melt container positioned upstream of the casting station.

Since the injection molding machine has no feeder distributor container, castings that have to be made with a plurality of feeder conduits spaced apart from one another cannot be made with it. Another disadvantage is the supply of melt to the casting furnace; the molten melt must be fed from the smelting furnace into the holding container and from there into the casting furnace, which entails major losses of metal and energy.

SUMMARY OF THE INVENTION

The object of the invention is to create a casting equipment and its method for producing castings in which the disadvantages of the prior art are overcome.

The advantages of the casting equipment of the invention and its process for producing castings are that the casting molds are filled with rising, nonturbulent melt; the feeding of castings through the feeder pressure pot is effected independently of the casting furnace; the melt is recompressed in the mold cavity via an arbitrary pressure; the residual melt in the feeder pressure pot is delivered for refilling of the casting mold with only slight heat losses; all the gas charging operations take place with inert gas, with air excluded; optimal thermal insulation of all the units involved in the casting process is assured; and no warming operation with a corresponding supply of melt to the casting stations is necessary. All of this leads to a considerable increase in productivity, major savings of energy, and higher quality, as well as improved mechanical properties of the castings.

BRIEF DESCRIPTION OF THE DRAWINGS

An exemplary embodiment will be described in further detail in conjunction with the drawings. Shown are.

DESCRIPTION OF THE PREFERRED EMBODIMENTS

Figure 1:
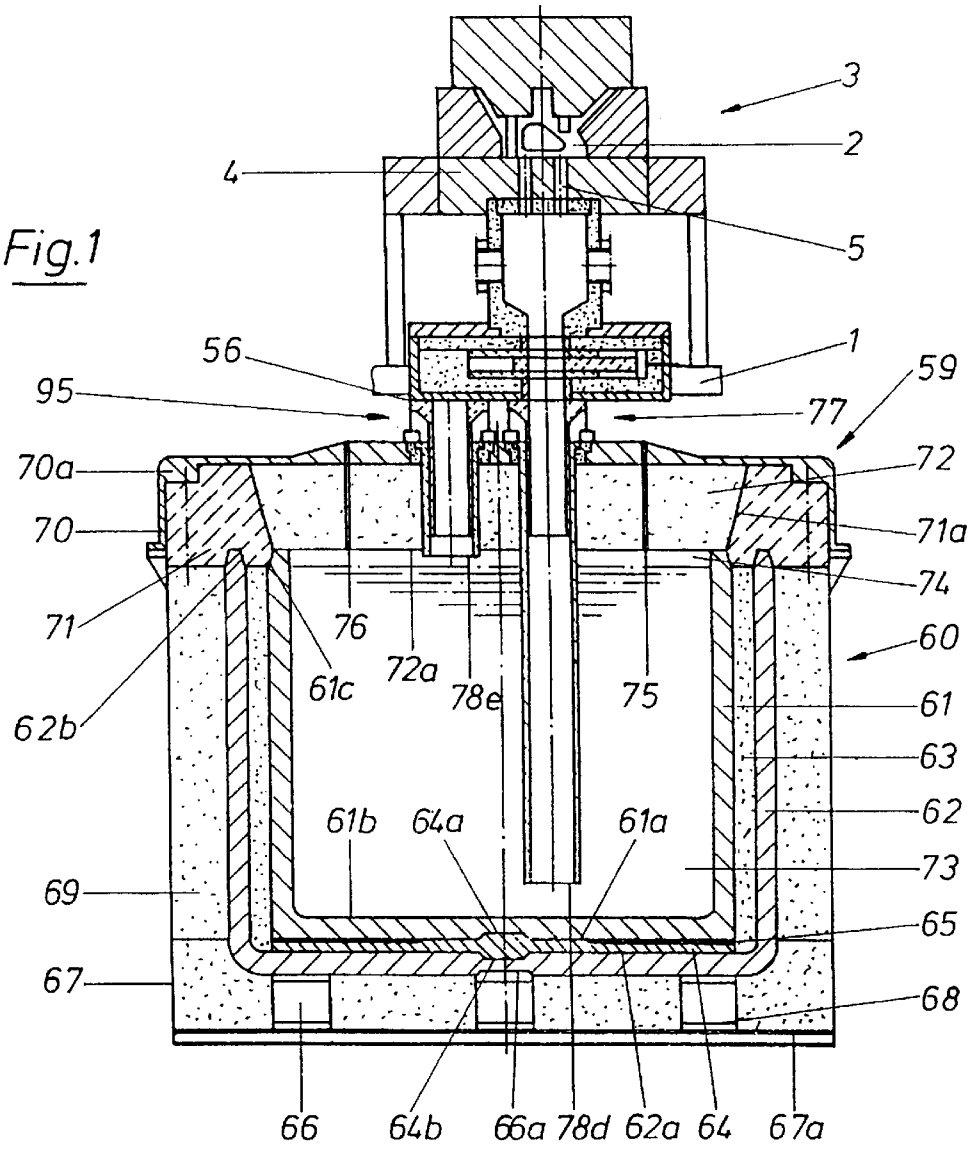
FIG. 1, a section through a casting plant according to the invention.

The casting plant comprises revolving or linear conveying devices, located on which are casting molds 3 whose bottom plate 4 has through openings 5 for the casting material, and a feeder pressure pot 6, secured below the casting mold bottom plate 4, with a recompression unit 17 mounted on the side wall of the feeder pressure pot 6 and a shutoff valve unit 32 secured below the feeder pressure pot 6. A casting or residual metal receiving station 59 is installed under the shutoff valve unit 32 and comprises a heated, hermetically sealed pressurized furnace 60, whose pressure chamber 74 is filled with melt 73 and on whose furnace cover 70 a movable pressure line 77 and a return line 95 are mounted. In a further version, the casting station 98 and the residual metal receiving station 99 form separate units. As well as a transport container 108 for supplying the molten metal.

Figure 3:
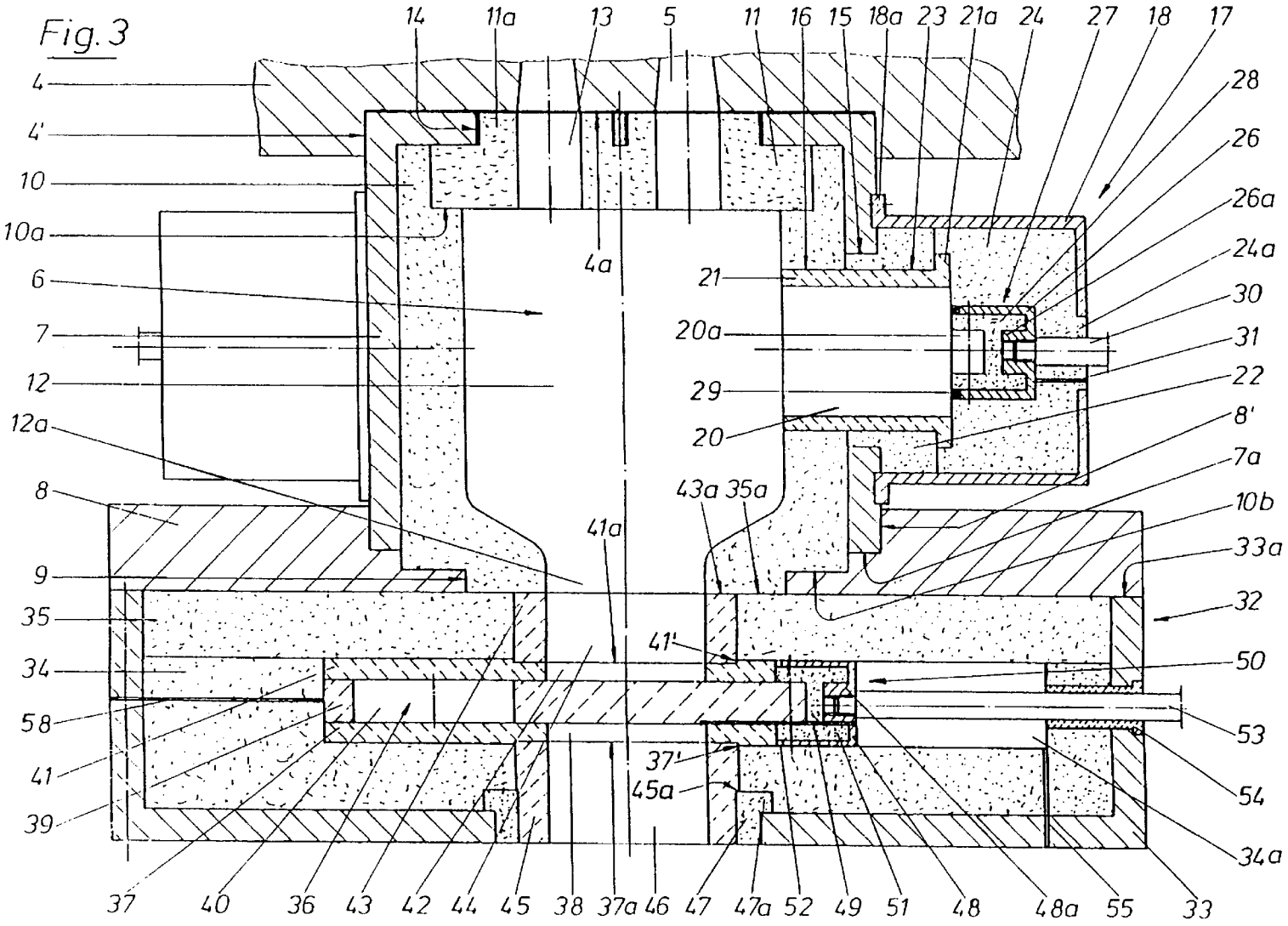
FIG. 3, an exemplary embodiment of a feeder pressure pot with a recompression unit and a shutoff valve unit, shown in detail.

In detail, as shown in FIG. 3, the feeder pressure pot 6 is formed by a steel housing 7, a bottom plate 8, an insulation housing 10, and a cover plate 11. The steel pressurized pot is inserted loosely, via a housing 7 by its vertical side walls 7*a*, into a corresponding recess of the bottom plate 8 and centered by the shoulder 8'. The cover plate 11 is inserted via recesses 10*a* of the vertical side walls of the insulation housing 10. The shoulders 11*a* of the cover plate 11 fill the openings 14 of the steel housing 7 and, via the recessed face 4*a* of the casting mold bottom plate 4, seal off the overflow openings 5 and 13 from escaping melt 73. The insulation housing 10 is received by the bottom plate 8 via a recess 10*b* and an opening 9 and is locked by the inner jacket face of the steel housing. The feeder pressure pot 6 may be embodied in parallelepiped or cylindrical form. Both the insulation housing 10 and the cover plate 11 are made of ceramic fiber materials.

The cylindrical steel housing 18 of the recompression unit 17 is inserted and screwed into a groove of the vertical outer wall 7 of the feeder pressure pot 6 via a collar 18*a*. In the interior, the steel housing 18 receives the pressure piston 20, the bush 21, the coupling 27, the actuating piston 30, and the bearing shells 22 and 24. Via openings 16 and 23 that are centered with respect to the steel housing 18, the bush 21 is inserted into both the insulation housing 10 and the bearing shell 22. The bush 21 is locked against displacement by both the collar 21*a*, seated in a recess of the bearing shell 24, and the end face of the bearing shell 22. The shoulder of the bearing shell 22 that fills the opening 15 in the vertical side wall 7 insulates the bush 21 from the feeder pressure pot 6. The piston 20, acting upon the confined melt in the opening 12 with pressure by displacement, is supported and guided in the bush 21. Via a coupling 27, the pressure piston 20 is connected to the actuating piston 30 of a displacement device. The peg 20*a* protruding into the interior of the steel coupling housing, and its connection with the steel housing 26, and the threaded eyelet 26*a* connecting the actuating piston are all enveloped by an insulating lining 28. With the interposition of a disk 29 made of thermal insulation, the dissipation of heat from the pressure piston 20 to the steel housing 26 of the coupling 27 is reduced. Via openings in the bearing shell 24, the disk 29, coupling 27 and actuating piston 30 are supported, and the piston 30 is insulated from the steel housing 18 via a shoulder 24*a* of the bearing shell 24. Through a bore 31, the requisite atmospheric pressure equalization in the reciprocation space of the pressure piston 20 is assured. Both the bush 21 and the piston 20 are made from ceramic or ceramic composite materials. The bearing shells 22 and 24, the disk 29, and the lining 28 comprise ceramic fiber materials.

Whether a plurality of recompression units 17 are provided depends both on the size of the feeder pressure pot and on the casting to be cast.

The shutoff valve unit 32 is screwed to the steel plate 8 of the feeder pressure pot 6 through a steel housing 33, via its vertical side walls 33*a*. Via a bottom plate 34, inserted loosely into the interior of the steel housing 33, and a cover plate 35 of thermal insulation, the heat loss of the shutoff valve 36 is reduced to a minimum. The valve guide plates 37 and 41, inserted loosely into the recess 34*a*, together with the shutoff slide plate 39 supported between them and connected to the coupling 50, form the shutoff slide valve 36. By means of bores disposed centrally to the overflow openings 12*a* in the bottom plate 34 and in the cover plate 35, spacer bushes 43 and 45 are inserted, which are received by their end faces by correspondingly cylindrical recesses 37*a*, 41*a* of the valve guide plates 37 and 41. The shoulders 37'and 41'center and lock the guide plates 37 and 41, and at the same time the overflow openings 38, 42, 44 and 46 for the melt 73 are centered both with respect to one another and with respect to the overflow opening 12*a* of the feeder pressure pot 6. In the melt closing position of the shutoff slide 39 with respect to the feeder pressure pot 6, the melt confined in the overflow opening 40 is sealed off via the valve guide plates 37 and 41 from leakage. The overflow openings 44 and 12*a* are sealed off from escaping melt by the faces 35*a* and 43*a* towards the bottom face of the insulation housing 10. The bush 47 of thermal insulation inserted into an opening in the steel housing 33 is received by a cylindrical recess 45*a* of the bush 45, and its collar 47*a* is centered via a recess in the bottom plate 34 and the spacer bush 45 is locked and heat transfer from the bush 45 to the steel housing 33 is also reduced. Via a coupling 50, the shutoff slide 39 is connected to the actuating piston 53 of a displacement device. The shutoff slide 39, protruding into the interior of the steel housing 48, and its connection with the steel housing 48, and also the threaded eyelet 48*a* connecting the actuating piston 53, are enveloped by an insulating lining 51. In the closed shutoff slide position, the steel housing 48 of the coupling 50 together with the valve guide plates 37 and 41 form an insulation void 52. Via a bush 54 inserted into the steel housing 33 and the bottom plate 34, the actuating piston 52 is received and centered. The atmospheric pressure equalization for the gas-tight reciprocation space of the shutoff slide 39 takes place through the opening 55, and the gas charging of the melt 73, present under the closed shutoff slide 39 after the casting mold has been filled, takes place through the conduits 49. The atmospheric pressure equalization of the reciprocation space for the shutoff slide 39, formed by the valve guide plates 37 and 41, takes place via the opening 58. The gas charging through the openings 49 and 55 takes place with inert gas and with air excluded, through a closed system communicating with the casting molds 3.

The components of the shutoff valve 37, 39, 41 and the bushes 43, 45 and 54 are made of ceramic or ceramic composite materials. The bottom plate 34, cover plate 35, lining 51 and bush 47 comprise ceramic fiber materials.

The feeder pressure pot 6, together with the recompression unit 17 and the shutoff valve unit 32, is inserted into a recess 4*a* of the casting mold bottom plate 4 and centered via the shoulder 4' and screwed to the bottom plate 4.

The casting or residual metal receiving station 59 shown in FIG. 1 comprises a pressurized furnace 60, a pressure line 77, and a return line 95. In detail, the pressurized furnace 60 comprises two crucibles 61 and 62, set one inside the other, whose vertical walls form a void which is filled with insulation material 63. An insulation plate 64, supported between the bottom faces 61*a* and 62*a*, which receives a heat source 65, for instance comprising electrical resistors. The heat transfer takes place directly to the bottom wall of the inner crucible 61. By means of the void filled with insulation material 63, the heat transfer from the heat source 65 to the outer crucible 62 is reduced to a minimum. By means of conically embodied shoulders 64*a* and 64*b*, the inner crucible 61 and the outer crucible 62 are centered with the insulation plate 64. The outer crucible 62 is supported on the furnace bottom 67*a* via studs 66. A centrally disposed stud, embodied with a conical shoulder 66*a* and received by a recess of the bottom wall of the outer crucible 62, the outer crucible 62 is centered with respect to the furnace jacket 67. To reduce heat dissipation from the outer crucible 62, the studs 66 are embodied with intermediately supported insulation plates 68. The voids, formed by the outer crucible 62 toward the furnace bottom 67*a* and the steel jacket 67 of the furnace, are lined with insulation materials 69. The segments 71, which are inserted into the furnace cover 70 and may also be annular in shape, are screwed to the threaded eyelets 70*a* of the furnace cover 70 via corresponding recesses. By means of conically embodied shoulders 61*c* and 62*b* of the vertical crucible walls, which are received by corresponding recesses of the segments 71, both the inner crucible 61 and the outer crucible 62 are centered and locked. The cover interior is lined with an insulation plate 72, which is positioned via the inclined faces 71*a* and which with the end face 72*a* seals off the pressure chamber 74 toward the end face of the inner crucible 61. The furnace cover 70, screwed to the furnace housing 67, thus forms a hermetically closed unit; the inner crucible 61 is filled with melt 73, and the gas pressure build up and reduction with insert gas is effected above the melt 73 through the openings 75 and 76.

The materials used for the inner crucible 61 may, depending on the metal melt to be cast, be made of graphite, silicon carbide, cast iron or cast steel.

The outer crucible 62 may be made from cast iron or from tamped or cast and sintered refractory compositions.

The plate 64, the insulation plates 68, and the segments 71 are made of ceramic or ceramic composite materials.

The insulation material 63, 69 and 72 comprises ceramic fiber materials.

Figure 4:
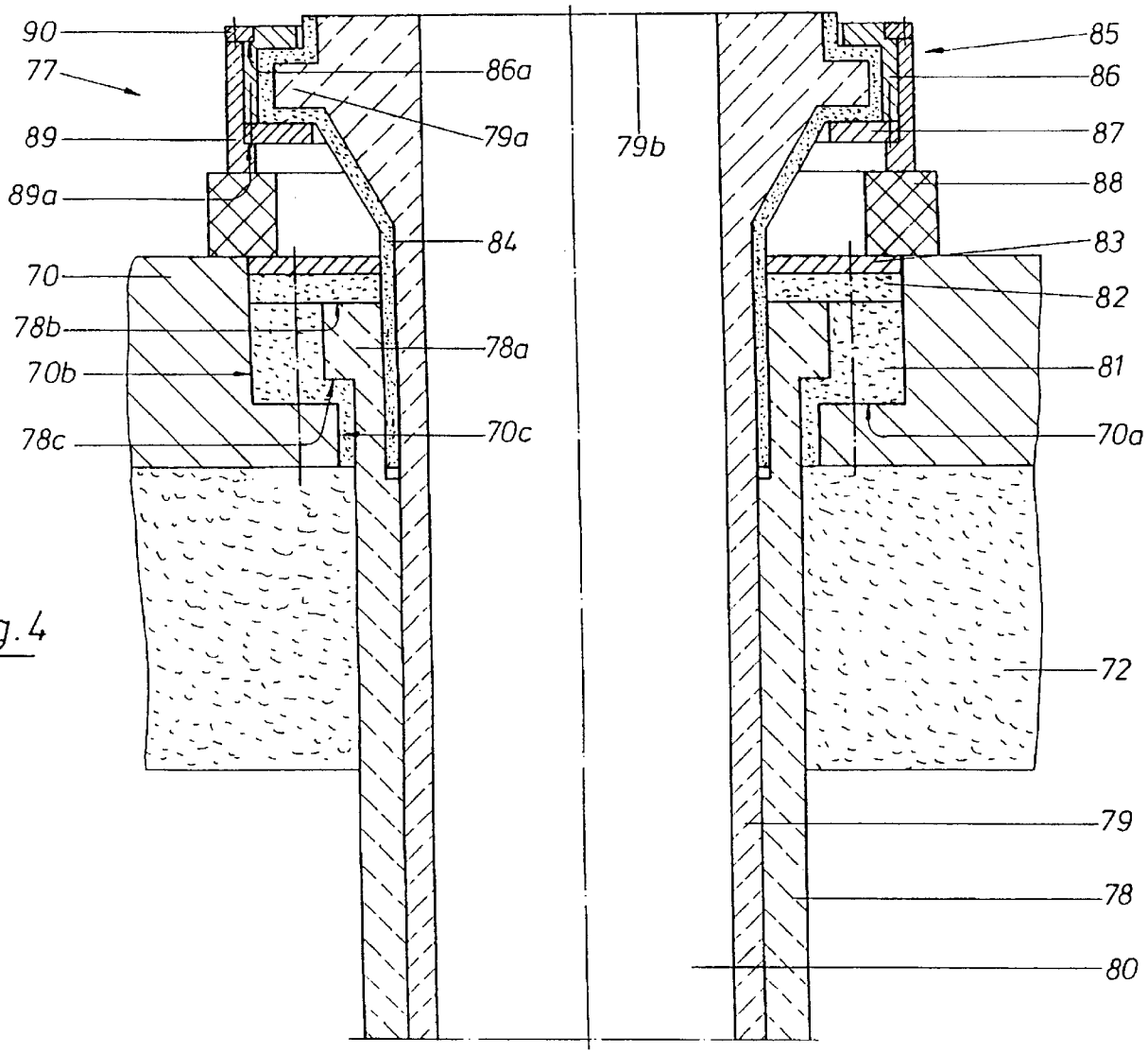
FIG. 4, an exemplary embodiment of a pressure line and return line, in detail.

The pressure line 77 mounted on the furnace cover 70 is shown in detail in FIG. 4.

Essentially, the pressure line 77 comprises a rigid tube 78, a movable tube 79, a coupling 85, and a motion device 88.

The tube 78 is inserted into an opening of the insulation late 72 of the furnace cover 70 and with the collar 78*a* is nserted into a bearing shell 81. Via cylindrically offset penings 70*b* and 70*c*, the bearing shell 81 is received by the furnace cover 70. Both the insulation ring 82, inserted into the furnace cover 70, and the inserted steel ring 83 are screwed together with the bearing shell 81 to the furnace cover 70 via the shoulder 70*a*. By means of the shoulder 78*c* and the end face 78*b*, the tube 78 is locked via the bearing shell 81, the insulation plate 82, and steel plate 83, and sealed off against gas leakage to the pressure chamber 74. With its end face 78*d* in FIG. 1, the tube 78 plunges into the melt 73 at a distance of 100 to 150 mm from the crucible bottom 61*b*. The tube 79 is inserted displaceably into the interior of the tube 78 and is positioned via a coupling 85 and the motion device 88. To minimize heat losses, the tube 79 is sheathed, beginning at the orifice 79*b*, with a thermal insulation 84, which is received by the openings both in the plates 82, 83 and in the tube 78. Via an annular claw 86 and 87, which clasps the insulated collar 79*a* of the tube 79, and a ring or annular segment 89 and its plate 90, the tube 79 is connected to the motion device 88.

The return line 95 shown in FIG. 1 is identical in its embodiment to the pressure line 77, except for the end face 78*e* that does not plunge into the melt 73.

The tube 78 and 79 is made of ceramic or ceramic composite materials. The bearing shell 81, insulation ring 82, and sheathing 84 comprise ceramic fiber materials.

Figure 2:
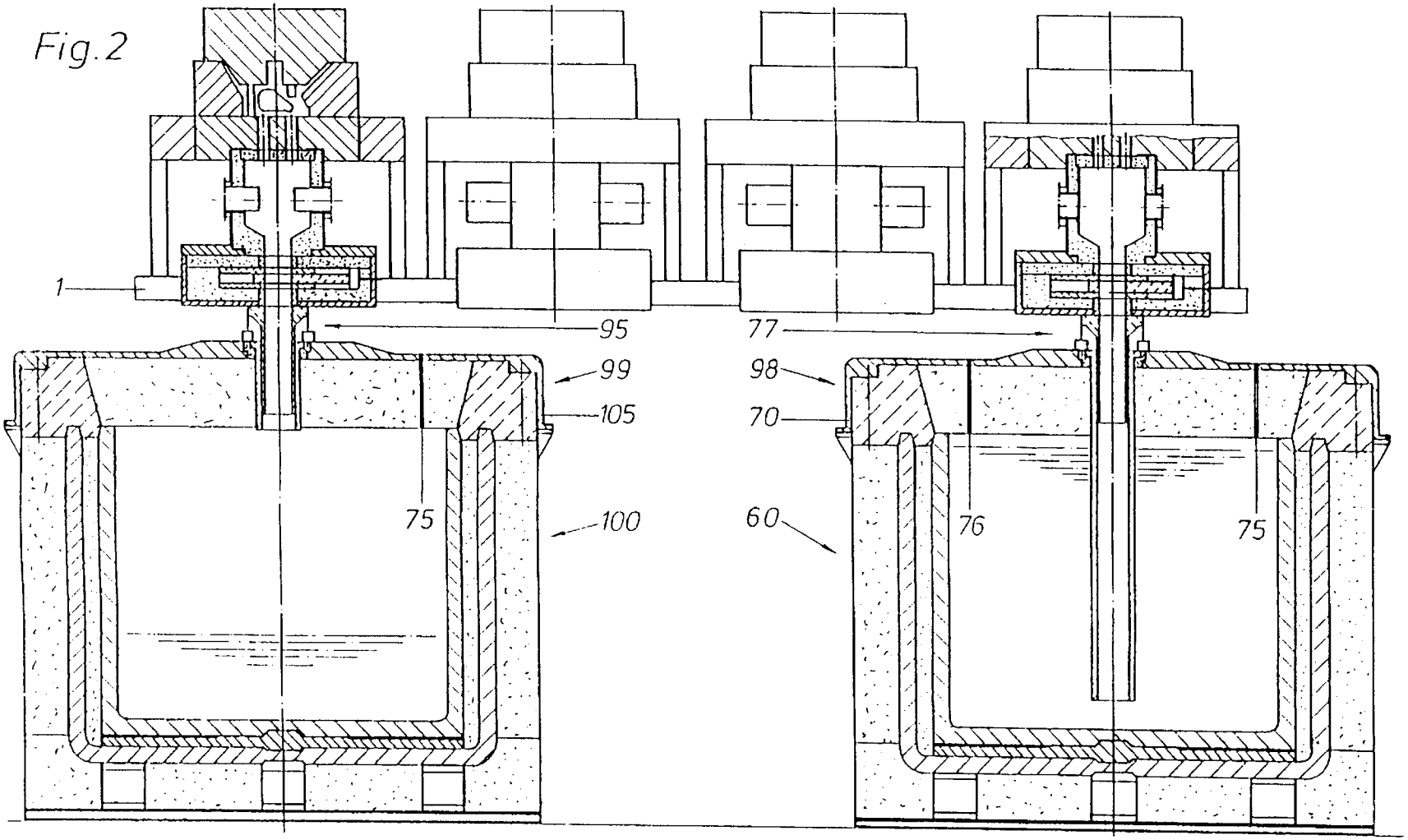
FIG. 2, a further exemplary embodiment of a casting plant.

A further exemplary embodiment of a casting plant, with a separate casting station 98 and a residual metal receiving station 99 spatially separated from it, is shown in FIG. 2. ere the casting station 98 is equipped with both a pressurized furnace 60 and a movable pressure line 77 secured to the furnace cover 70. The residual metal receiving station 99 has a holding furnace 100, with a movable return line 95 mounted on the furnace cover 105. The gas supply to the feeder pressure pot 6 is effected through the opening 75 in the furnace cover 105, at atmospheric pressure with inert gas, over the surface of the molten bath in the crucible space 74, and via the return line 95 and the opened shutoff valve 36. Except for the opening 76 made in the pressurized furnace cover 70, the holding furnace 100 is identical in design to the pressurized furnace 60.

Figure 5:
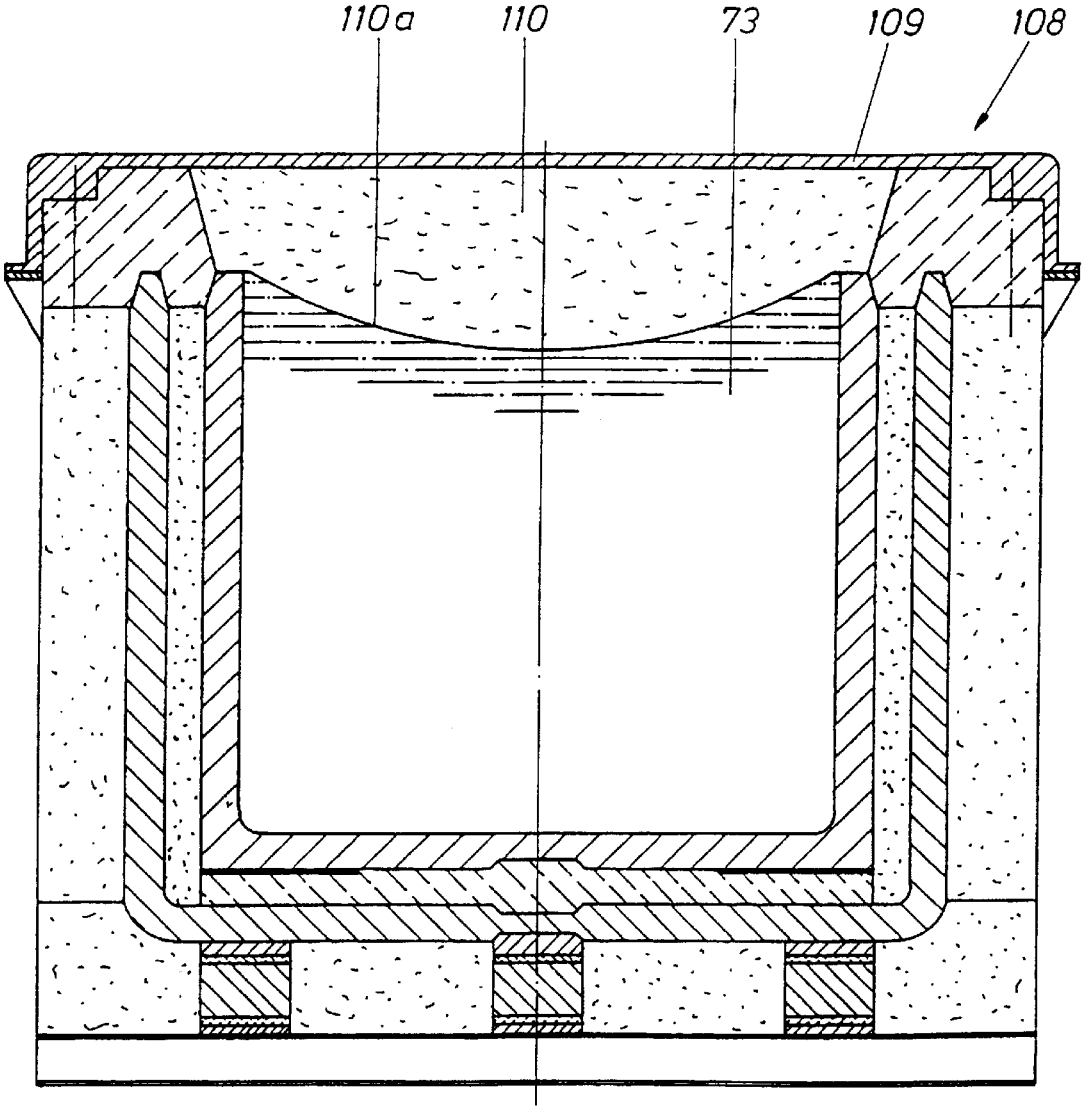
FIG. 5, an exemplary embodiment of a container for molten metal transport.

The molten metal transport container 108 shown in FIG. 5 is identical in design to the pressurized furnace 60, except for the furnace cover 109. Unlike the furnace cover 70, the lining 110 of the furnace cover 109 is made with a spherical segment 110*a*, which plunges into the melt 73, reduces the surface area of the melt, and thus prevents sloshing of the melt at the surface during transport. The furnace cover 109 also has no openings.

It should also be noted that design details may certainly be different from the exemplary embodiments shown without departing from the scope of the claims.

The casting plant and its method for producing castings functions as follows:

A casting mold 3, moved by the conveying device 1 into the casting or residual metal receiving station 59 is locked centrally to the overflow openings 46 and 80 of both the pressure line 77 and the shutoff valve unit 32. Before the casting mold is filled, the orifice of the pressure line 77, located spaced slightly below the overflow face of the shutoff valve unit 32, is pressed against the overflow opening face of the shutoff valve unit 32, with the interposition of the seal 56, by actuation of the motion device 88. By means of a slight gas pressure buildup above the melt 73 in the hermetically sealed pressurized furnace 60, the melt 73 is forced into the mold void 2 via the openings of the pressure line 77, the shutoff valve unit 32, the opening 40 of the shutoff valve, the feeder pressure pot 6, and the openings 13 and 5 distributing the melt 73 to a plurality. Immediately after the mold has been filled, the melt 73 located above the valve 36 is confined by actuation of the shutoff slide 39. The immediate actuation of one or more pressure pistons 20 that then ensues leads to an increase in pressure in the confined melt 73 because of the action of the piston on the face end thereon. The magnitude of the pressure can be selected arbitrarily. At the same time, shortly before the terminal closure position of the shutoff slide 39 is reached, the gas pressure above the melt in the pressurized furnace 60 is reduced, and the gas charging conduits 49 embodied below the shutoff slide 39 open; by aspiration of inert gas, the column of melt present below the shutoff slide 39 is lowered into the pressurized furnace 60. After the melt has been lowered, the pressure line 77 is returned to its outset position by actuation of the motion device 88, and the casting mold 3 leaves the casting or residual metal receiving station 59, while at the same time the next casting mold 3 follows it into the casting or residual metal receiving station 59 to be filled with melt 73. In the ensuing cooling segment, the casting 2 solidifies; the volumetric deficit from the solidification of the casting 2 is compensated for by the piston 20 acting on the melt 73 in the feeder pressure pot 6. Shortly before the casting solidifies, the casting mold 3 leaves the cooling segment and is locked in the casting or residual metal receiving station 59 centrally to the overflow openings 46 and 80 in both the return line 95 and the shutoff valve unit 32. By the actuation of the motion device 88, the orifice face of the return line 95, which is located spaced slightly below the shutoff valve unit 32, is pressed with the interposition of a seal 56 against the overflow opening face of the shutoff valve unit 32. By the actuation of the shutoff slide 39, the overflow opening 40 to the return line 95 is opened, and the residual melt located both in the feeder pressure pot 6 and above the shutoff slide 39 flows back into the pressurized furnace 60 via the return line 95, with the aspiration of inert gas that is present at atmospheric pressure above the melt 73 in the pressurized furnace 60. After the feeder pressure pot has been evacuated, the pressure piston is returned to its outset position by the actuation of the motion device, and the shutoff valve 66 confines the inert gas in the feeder pressure pot 6 by actuation of the motion device. By the actuation of the motion device 88, the return line 95 is returned to its outset position, and the solidified casting 2 can be removed from the casting mold 3. Once the casting mold 3 has been made ready for casting, new casting operation takes place in the casting or residual metal receiving station 59; in this process, the inert gas confined in the feeder pressure pot 6 forms a protective layer, during casting mold filling, over the melt surface that rises upward in the mold void 2. Before the gas pressure buildup in the crucible space 74, the orifice face of the return line 95 is closed in gas-tight fashion, with the interposition of a seal 56 on a plate or the shutoff valve unit 32, by actuation of the motion device 88.

In conveying devices with a linear course of motion and a contrary direction, the casting molds 3 after being filled in the casting or residual metal receiving station 59 must be returned in opposite directions to their outset position, where, after the casting has solidified, the residual melt in the feeder pressure pot 6 has been evacuated, and the casting has been removed, they can then be refilled with melt 73 in the casting or residual metal receiving station 59.

The course of operation in FIG. 2, in which the casting station 98 is spatially separated from the residual metal receiving station 99, differs from the casting or residual metal receiving station 59 only in that the residual metal receiving station 99 has a holding furnace 100 and a return line 95 that receives the residual melt, after casting solidification, from the feeder pressure pot 6 via the return line and collects it, and that the travel segment from the residual metal receiving station 99 to the casting station 98, which has a pressure line 77, is utilized for removing the castings, cleaning the casting mold 3, and the placement of cores or loose parts, and the casting mold filling takes place in the casting station 98.

The molten metal furnished by the transport container 108, as shown in FIG. 5, can be temporarily stored in the transport container 108 by heating via the heat source 65, or can be poured directly, via a change of furnace cover, into the casting or residual metal receiving station 59 and the casting station 98.

What is claimed is:

1. A casting plant for low-pressure casting of molten metal with operatively and kinematically connected units in the form of linear or revolving conveying devices comprising:

casting molds constructed and arranged to be filled with molten metal intermittently or continuously, and disposed either in a casting or residual metal receiving station or in a separate casting station;

an insulated feeder pressure pot with a recompression unit and a shutoff valve unit having gas charging conduits flanged to the underside of the casting mold, the insulated feeder pressure pot being constructed and arranged to receive excess molten metal from the casting mold after a casting therein has solidified;

a casting or residual metal receiving station, disposed beneath the casting molds and comprising a hermetically sealed, insulated pressurized furnace in which two assembled crucibles are disposed, including an inner crucible forming a pressure chamber for filling with molten metal, a furnace cover having a movable pressure line and a movable return line for the molten metal passing therethrough, the pressure line extending from the shutoff valve unit to a portion of the crucible which is constructed and arrange to be below the surface of the molten metal therein, and the return line extending from the shutoff valve unit to a portion of the crucible constructed and arranged to be above the surface of the molten metal contained therein, and a transport container for transporting molten metal to the casting plant.

2. The casting plant of claim 1 wherein the feeder pressure pot (6) together with the shutoff valve unit (32) and the recompression unit (17) are embodied as separable component units and form a hermetic unit with the casting mold (3).

3. The casting plant of claim 2, wherein the recompression unit (17) comprises a pressure piston (20) supported in a bush (21), coupled with a motion device, embedded in bearing shells (22, 24) of thermal insulation, and sheathed by a steel housing (18).

4. The casting plant of claim 3, wherein the pressure piston (20), the bush (21), and a shoulder of the bearing shell (22) form the openings (15, 16) in the feeder pressure pot (6), and end faces of the bush (21) and of the pressure piston (20) form a flat face with a vertical inside jacket of the insulation housing (10).

5. The casting plant of claim 4, wherein a coupling (27) between the pressure piston (20) and a motion rod (30) has a cylindrical steel housing (26), which towards the rod has a threaded eyelet **(26*a*), located in the interior of the pot, to which eyelet the motion rod (30)** is screwed.

6. The casting plant of claim 5, wherein an interior portion of a steel housing (26) of the coupling (27) is lined with thermal insulation (28) having recesses and openings enveloping a driver peg **(20*a*) of the pressure piston (20) and its driving connection and the threaded eyelet (26*a*)**.

7. The casting plant of claim 6, wherein a disk (29) of thermal insulation embodies a chamber between the end faces of the pressure piston (20), the steel housing (26), and the lining (28) of the coupling (27).

8. The casting plant of claim 5, wherein the interior of the steel housing (18) surrounding the recompression unit (17) comprises two bearing shells (22, 24) of thermal insulation, which via loosely connected recesses, shoulders and openings receive and envelop the pressure piston (20), bush (21), coupling (27), a disk (29), and the motion rod (30).

9. The casting plant of claim 3, wherein the pressure piston (20) and the bush (21) comprise ceramic or ceramic composite materials.

10. The casting plant of claim 3, wherein the thermal insulation comprises ceramic fiber.

11. The casting plant of claim 2, wherein the shutoff valve unit (32) comprises a steel housing (33), a bottom plate (34) and cover plate (35) that form the interior of the steel housing (33), openings (44, 46) for the metal melt that are formed by two bushes (43, 45), a shutoff valve unit (36) with a coupling (50) and an actuating piston (53), and gas charging openings (49, 55, 58).

12. The casting plant of claim 11, wherein the bottom plate (34) has a recess **(34*a*), which receives both the shutoff valve unit (36) and the coupling (50) and forms the chamber for the displacement travel of a shutoff plate (39) of the shutoff valve unit and the coupling (50)**.

13. The casting plant of claim 11, the shutoff valve unit (36) has a displaceable plate (39), which is supported between an upper and a lower plate (41, 37) which have openings (38, 40, 42) for the casting material, and is received by the recess of the bottom plate **(34*a*)**, the upper plate resting on the underside of the cover plate.

14. The casting plant of claim 13, wherein the openings for the casting material comprise the steel housing (33) of the shutoff valve unit (32), the bottom plate (34), and cover plate (35), two bushes (33, 45), which are received on the face end, vertically to the shutoff valve (36), via recesses (37*a*, 41*a*) of the upper and lower valve plate (37, 41), and the end face of the bush (43) opposite the upper valve plate (41) rests on the through opening surface of the insulation housing (10) of the feeder pressure pot (6), and the lower bush (45), via a shoulder (45*a*) in the jacket face, is received by a bush (47) comprising thermal insulation and forms a single surface with the horizontal outer wall of the steel housing (33).

15. The casting plant of claim 14, wherein the bush (47) formed of thermal insulation has a collar (47*a*), which is received by a recess of the bottom plate (34) and rests on the inner wall of the steel housing (33) and ends with the lower wall of the steel housing.

16. The casting plant of claim 14, wherein individual parts (34, 35, 37, 39, 41, 43, 45, 47, 50) forming the shutoff valve unit are inserted loosely into the interior or the wall of the steel housing and through recesses (34*a*, 37*a*, 41*a*, 45*a*), openings, and corresponding shoulders (37', 41') form a force-locking hermetic unit together with the steel housing (33) of the shutoff valve unit (32).

17. The casting plant of claim 14, wherein the valve plates (37, 41), the displaceable plate (39), the bushes (43, 45) having the openings for the casting material, and the receiving bush (54) for the actuating piston (53) comprise ceramic or ceramic composite materials.

18. The casting plant of claim 11, wherein the coupling (50) has a steel housing (48), which is open towards the valve and on the opposite site has a threaded eyelet (48*a*), located in an interior portion of the housing (48), into which eyelet the actuating piston (53) is screwed, which piston is received by an opening in the side wall of the steel housing (33) and in the bottom plate (34), the opening being formed by a bush (54).

19. The casting plant of claim 18, wherein the interior portion of the steel housing (48) of the coupling (50) is lined with a thermal insulation (51), which via recesses envelops a shutoff slide (39) that protrudes into the coupling (50), as well as the threaded eyelet (48*a*) and a the connection of the coupling (50) with the shutoff slide (39).

20. The casting plant of claim 11, wherein the shutoff valve unit (32) has gas charging openings (55, 58) in the steel housing (33) and in the bottom plate (34) as well as at least one gas charging opening (49) in the coupling (50) and on the underside of the shutoff slide plate (39).

21. The casting plant of claim 1, wherein the feeder pressure pot (6) comprises an insulation housing (10) with a cover plate (11) and a steel housing (7) with a bottom plate (8) that has overflow openings (12, 12*a*, 13) for the casting material and at least one lateral opening (15, 16) for imposing pressure on the melt.

22. The casting plant of claim 21, wherein the insulation housing (10) comprises a cover plate (11), provided with shoulders (11*a*), and a bottom plate (10*b*), which are inserted into corresponding recesses of the steel housing (7) and its bottom plate (8) and come to rest on an underside (4*a*) of the casting mold and on the shutoff valve unit (32).

23. The casting plant of claim 22 wherein the insulation housing (10) has vertical side walls, which are provided with the shoulders (10*a*) and into which walls the cover plate (11) is inserted.

24. The casting plant of claim 22, wherein the steel housing (7) is inserted by vertical side walls thereof (7*a*) into the bottom plate (8) via corresponding shoulders.

25. The casting plant of claim 24, the steel housing (33) rests with the vertical side walls (33*a*) on the bottom plate (8) of the feeder pressure pot (6), and the interior forms a bottom plate (34) as well as a cover plate (35) of thermal insulation, the cover plate (35) resting on both the bottom plate (8) and the insulation housing (10) of the feeder pressure pot (6).

26. The casting plant of claim 25, wherein the thermal insulation comprises ceramic fiber.

27. The casting plant of claim 22, wherein the insulation housing (10) with the cover plate (11) comprises ceramic fiber.

28. The casting plant of claim 21, wherein the insulation housing (10, 11) is loosely surrounded by the steel housing (7).

29. The casting plant of claim 21, wherein the shutoff valve unit (32) is disposed below the feeder pressure pot (6) and is connected to the bottom plate (8) of the feeder pressure pot (6).

30. The casting plant of claim 1, the recompression unit (17) is disposed horizontally along a vertical steel housing wall of the feeder pressure pot (6).

31. The casting plant of claim 30; wherein the steel housing (18) of the recompression unit (17) is inserted, centered and screwed via a collar (18*a*) into a groove of the vertical side wall of the feeder pressure pot (6).

32. The casting plant of claim 1, wherein the movable pressure line (77) or a return line is formed by an outer tube (78) which is secured in the furnace cover (70, 105) and whose inner jacket receives an inner tube (79) that is connected to a motion unit (88) disposed on the furnace cover.

33. The casting plant of claim 32, wherein the furnace cover (70, 105) has a lining and at least one cylindrical opening provided with a circumferential shoulder (70*a*), on which a bearing shell (81) rests, with a lower end face on the furnace cover lining (72).

34. The casting plant of claim 33, wherein the outer tube (78) on an upper end face has a cylindrical collar (78*a*), which is received by the bearing shell (81) resting on the furnace cover and by the inner jacket face of the bearing shell, the bearing shell (81) comprising thermal insulation.

35. The casting plant of claim 33, wherein the outer tube (78) is separably connected to the furnace cover (70, 105) via a cylindrical steel plate (83) and an intermediate plate (82) resting on the end face (78*b*) of the tube (78) and the bearing shell (81), and the intermediate plate (82) comprising thermal insulation.

36. The casting plant of claim 35, wherein the inner tube (79), above the furnace cover (70, 105), via an outer jacket, forms a cylindrical collar, which is offset vertically via an incline, a protrusion (79*a*), and from there to an orifice face (79*b*) of the inner tube (79).

37. The casting plant of claim 36, wherein the outer jacket of the inner tube (79) has sheathing (84) of thermal insulation, which is received via a recessing of the inner jacket of the outer tube (78) and by the openings in the steel plate (83) and the intermediate plate (82).

38. The casting plant of claim 37, wherein the connection with the motion unit (88), is via an annular claw (86, 87) whose lower leg (87) is separably connected to the vertical wall, clasping a sheathed protrusion (79*a*) of the inner tube (79), and an actuation segment comprises a lower shoulder and a plate (90) located at the top that is connected to the vertical side wall and received by a shoulder (86*a*) in the claw (86, 87) and embraces the claw via the end faces.

39. The casting plant of claim 37, wherein the thermal insulation comprises ceramic fiber.

40. The casting plant of claim 32, wherein the outer tube (78) and the inner tube (79) of the pressure line or return line comprises ceramic or ceramic composite materials.

41. The casting plant of claim 1, wherein the pressurized furnace (60), the holding furnace (100) and the transport container (108) comprise two crucibles (61, 62) in the furnace that are disposed one inside the other, an intermediate plate (64) with a heat source (65), a support bearing (66), a steel jacket (67), and a cover (70, 105, 109) with inserted segment plates (71), and lined with thermal insulation materials.

42. The casting plant of claim 41, wherein a vertical outer wall of the inner crucible (61) toward a vertical inner wall of the outer crucible (62) forms a void which is lined with thermal insulation (63).

43. The casting plant of claim 41, wherein a the bottom face (61*a*) of the inner crucible (61) rests on an intermediate plate (64) which has a heat source (65).

44. The casting plant of claim 43, wherein the plate (64) receiving the heat source (65) has centered, conically offset shoulders (64*a*, 64*b*) on upper and lower face ends, which shoulders are received by recesses in both a lower bottom wall of the inner crucible (61) and a inner bottom wall (62*a*) of the outer crucible (62).

45. The casting plant of claim 41, wherein the heat source (65) is encapsulated against energy losses via the void formed by thermal insulation (63) and by the vertical outer wall of the inner crucible (61) and the vertical inner,wall of the outer crucible (62) and by the intermediate plate (64).

46. The casting plant of claim 41, wherein a lower bottom face of the outer crucible (62) rests on peripheral studs (66), which are disposed in a circle relative to the bottom face and are supported on a furnace bottom (67*a*).

47. The casting plant of claim 46, a centrally disposed stud (66) supported on the furnace bottom (67*a*) plunges with a conically formed shoulder (66*a*) into a bottom wall of the outer crucible (62).

48. The casting plant of claim 46, wherein the studs (66) have intermediately supported insulating plates (68).

49. The casting plant of claim 41, wherein the voids between the outer wall of the outer crucible (62) toward the furnace jacket (67) and the furnace bottom (67*a*) comprise thermal insulation (69).

50. The casting plant of claim 41, wherein on the top sides of the crucibles, both the outer wall of the inner crucible (61) and the inner and outer wall of the outer crucible (62) have conical shoulders (61*c*, 62*b*) toward the end face, which are received by corresponding recesses in the lining of the furnace cover (72, 110) and by the segment plates (71) screwed to the furnace cover (70, 105, 109).

51. The casting plant claim 50, wherein the at least four segment plates (71), resting on the horizontal and vertical inner walls of the furnace cover (70, 105, 109), via recesses receive the threaded eyelets (70*a*) formed by the furnace cover, and via the annular shoulder edge, on the upper end face of the inner crucible (61), form a respective inclined face (71*a*) extending toward the vertical inner wall of the furnace cover (70, 105, 109), and rest with the lower end face on the furnace chamber lining (69).

52. The casting plant of claim 51, wherein the lining (72, 110, 110*a*) of the furnace cover interior comprises thermal insulation and rests on the circumference via at least four recesses on the segment plates (71), the lower face resting via a recess (72*a*) on the annular face of the inner crucible (61) and the outer face resting on the lining (69) of the furnace chamber.

53. The casting plant of claim 41, wherein the steel jacket (67) is screwed to the cover (70, 105, 109), and the connections of the pressure line (77) and return line (95) to the furnace cover (70, 105) form a pressure-tight unit.

54. The casting plant of claim 41, wherein the cover (70) of the pressurized furnace (60) has at least one opening each for receiving the pressure line (77) and the return line (95) and also has two openings (75, 76) for building up and reducing gas pressure on the surface of the molten bath.

55. The casting plant of claim 41, wherein the cover (105) for the holding furnace (100) has one opening for the return line (95) and one opening (75) for gas supply to the feeder pressure pot (6) and the crucible chamber (74).

56. The casting plant of claim 41, wherein the container (108) for molten metal transport has a spherical segment (110*a*), formed via the lining (100) of the furnace cover (109) and plunging into the melt, which segment reduces the melt surface area toward the inner crucible wall (61) to a minimum.

57. The casting plant of claim 41, wherein the thermal insulation comprises ceramic fiber.

58. The casting plant of claim 41, wherein the intermediate plate (64), insulating plates (68), and segment plates (71) comprise ceramic or ceramic composite materials.

59. The casting plant of claim 41, wherein the inner crucible comprises graphite, silicon carbide, cast iron, or cast steel.

60. The casting plant of claim 41, the outer crucible (62) comprises cast iron or tamped, cast and sintered refractory compositions.

61. A method for producing castings by operation of a casting plant for low-pressure casting of molten metal with operatively and kinematically connected units in the form of linear or revolving conveying devices comprising:

casting molds constructed and arranged to be filled with molten metal intermittently or continuously, and disposed either in a casting or residual metal receiving station or in a separate casting station;

an insulated feeder pressure pot with a recompression unit and a shutoff valve unit having gas charging conduits flanged to the underside of the casting mold, the insulated feeder pressure pot being constructed and arranged to receive excess molten metal from the casting mold after a casting therein has solidified;

a casting or residual metal receiving station, disposed beneath the casting molds and comprising a hermetically sealed, insulated pressurized furnace in which two assembled crucibles are disposed, including an inner crucible forming a pressure chamber for filling with molten metal, a furnace cover having a movable pressure line and a movable return line for the molten metal passing therethrough, the pressure line extending from the shutoff valve unit to a portion of the crucible which is constructed and arranged to be below the surface of the molten metal therein, and the return line extending from the shutoff valve unit to a portion of the crucible constructed and arranged to be above the surface of the molten metal contained therein, and a transport container for transporting molten metal to the casting plant, comprising the steps of:

a) pressing the pressure line (77) against the shutoff valve unit (32) in closed condition, b) building up a casting pressure by positive displacement of material to be cast into the feeder pressure pot (6) in opened condition and the casting mold (3), c) after closure of the feeder pressure pot, lowering of the melt with aspiration of gas into the casting furnace (60), with simultaneous return of the pressure line (77) to its outset position, in which process the casting mold (3) leaves the casting or residual metal receiving station (59) or a separate casting station (98) and is followed by a subsequent mold to be filled, d) arbitrarily building up pressure on the melt confined in the feeder pressure pot (6), e) shortly before the casting solidifies, pressing the return line (95) against the closed shutoff valve unit (32), f) causing return flow of the residual metal located in the feeder pressure pot (6) after the opening of the shutoff valve (39) with aspiration of gas out of the furnace atmosphere into the casting or residual metal receiving station (59) or a separate residual metal receiving station (99), g) before the return line (95) is lowered, assuring gas inclusion in the feeder pressure pot (6) by closure of the shutoff valve (39), h) temporarily storing furnished molten metal by heating the transport container (108), and i) inserting molten metal, by changing the furnace cover of the transport container (108), into the casting or residual metal receiving station (59) or a separate casting station (98).

62. The method of claim 61, wherein at least two casting molds are supporting by conveying devices (1) with a linear course of motion and a contrary direction, the at least two casting molds being filled with melt in succession in the casting or residual metal receiving station (59) and after the last casting mold has been filled return to their outset position, and shortly before the casting solidifies are moved into the residual metal receiving position of the casting or residual metal receiving station (59), and the residual melt in the feeder pressure pot (6) is lowered into the pressurized furnace (60) via the return line (95), and after the casting has been removed from the casting mold (3), the casting mold is re- filled with melt.

63. The method of claim 61, wherein the casting solidification takes place independently of the casting furnace (60).

64. The method of claim 61, wherein compensation for volumetric deficit of the solidifying casting is assured by means of an arbitrary pressure acting upon the melt in the feeder pressure pot (6).

65. The method of claim 61, wherein gas charging of a column of molten metal takes place on an underside of the shutoff valve (39), with inert gas.

66. The method of claim 61, wherein before the feeder pressure pot (6) is filled with melt, openings **(12, 12*a*, 13, 44)** of the pot have an inert gas volume.

67. The method of claim 61, wherein the transport of melt from the casting furnace (60) into the mold, and the return of melt after filling of the mold and after solidification of the casting take place under a protective gas atmosphere.

68. The method of claim 61, wherein the gas charging of surfaces of melt in the casting and holding furnaces (60, 100) takes place with inert gas.

69. The method of claim 61, wherein the pressurized furnace (60), the holding furnace (100), and the molten metal transport container (108) are changeable into a pressurized or holding furnace (60, 100) or molten metal transport container (108) by changing furnace covers (70, 105, 109).

70. The method of claim 61, wherein atmospheric pressure equalization above the melt is assured with inert gas through an opening (75) in the furnace cover (105) of the holding furnace (100).

71. The casting plant of claim 61, additionally comprising a separate casting station with a residual metal receiving station spatially separated therefrom.

* * * * *